US010172436B2

(12) United States Patent
Vanman et al.

(10) Patent No.: US 10,172,436 B2
(45) **Date of Patent: *Jan. 8, 2019**

(54) METHOD AND SYSTEM OF SECURING WEARABLE EQUIPMENT

(71) Applicant: WatchGuard, Inc., Allen, TX (US)

(72) Inventors: Robert V. Vanman, McKinney, TX (US); Jim Dulaney, Euless, TX (US); Larry Hall, Richardson, TX (US); Gary Burton, Melissa, TX (US); James Walter Exner, Plano, TX (US)

(73) Assignee: WatchGuard, Inc., Allen, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/794,330

(22) Filed: Oct. 26, 2017

(65) Prior Publication Data

US 2018/0049538 A1 Feb. 22, 2018

Related U.S. Application Data

(63) Continuation of application No. 14/821,148, filed on Aug. 7, 2015, now Pat. No. 9,861,178.

(60) Provisional application No. 62/067,586, filed on Oct. 23, 2014.

(51) Int. Cl.
*A45F 3/00* (2006.01)

(52) U.S. Cl.
CPC ..... *A45F 3/005* (2013.01)

(58) Field of Classification Search
CPC .... A45F 5/02; A45F 5/021; A45F 2200/0591; F41C 33/045
See application file for complete search history.

(56) References Cited

U.S. PATENT DOCUMENTS

| | | | |
|---|---|---|---|
| 4,128,194 | A | 12/1978 | Hinz |
| 4,258,421 | A | 3/1981 | Juhasz et al. |
| 4,688,244 | A | 8/1987 | Hannon et al. |
| 4,831,438 | A | 5/1989 | Bellman, Jr. et al. |
| 4,949,186 | A | 8/1990 | Peterson |
| 5,027,104 | A | 6/1991 | Reid |

(Continued)

FOREIGN PATENT DOCUMENTS

| | | | |
|---|---|---|---|
| EP | 707297 | A1 | 4/1996 |
| FR | 2698596 | B1 | 2/1995 |

(Continued)

OTHER PUBLICATIONS

ICOP Extreme Wireless Mic, Operation Supplement; 2008.

(Continued)

*Primary Examiner* — Corey Skurdal
(74) *Attorney, Agent, or Firm* — Winstead PC

(57) ABSTRACT

A system and method for attaching a device to a user includes securing a first plate to a user. The first plate can be secured to the user, for example, via one or more straps and/or a hook and loop fastener. The system and method further include securing a second plate to the first plate, wherein an article of the user's clothing is sandwiched in between the first plate and the second plate. The first plate and second plate may be secured to each other by a magnetic connection, by engagement of a sliding pin that pierces a portion of the first plate and the second plate, or a combination of a magnetic connection and an engagement of a sliding pin.

21 Claims, 8 Drawing Sheets

(56) References Cited

U.S. PATENT DOCUMENTS

| | | | |
|---|---|---|---|
| 5,164,827 | A | 11/1992 | Paff |
| 5,430,431 | A | 7/1995 | Nelson |
| 5,579,239 | A | 11/1996 | Freeman et al. |
| 5,677,979 | A | 10/1997 | Squicciarini et al. |
| 5,689,442 | A | 11/1997 | Swanson et al. |
| 5,708,780 | A | 1/1998 | Levergood et al. |
| 5,734,337 | A | 3/1998 | Kupersmit |
| 5,742,336 | A | 4/1998 | Lee |
| 5,787,367 | A | 7/1998 | Berra |
| 5,799,083 | A | 8/1998 | Brothers et al. |
| 5,815,093 | A | 9/1998 | Kikinis |
| 5,852,664 | A | 12/1998 | Iverson et al. |
| 5,857,159 | A | 1/1999 | Dickrell et al. |
| 5,917,405 | A | 6/1999 | Joao |
| 5,920,338 | A | 7/1999 | Katz |
| 5,926,210 | A | 7/1999 | Hackett et al. |
| 6,008,841 | A | 12/1999 | Charlson |
| 6,076,026 | A | 6/2000 | Jambhekar et al. |
| 6,151,065 | A | 11/2000 | Steed et al. |
| 6,211,907 | B1 | 4/2001 | Scaman et al. |
| 6,259,475 | B1 | 7/2001 | Ramachandran et al. |
| 6,332,193 | B1 | 12/2001 | Glass et al. |
| 6,421,080 | B1 | 7/2002 | Lambert |
| 6,430,488 | B1 | 8/2002 | Goldman et al. |
| 6,490,513 | B1 | 12/2002 | Fish et al. |
| 6,518,881 | B2 | 2/2003 | Monroe |
| 6,542,076 | B1 | 4/2003 | Joao |
| 6,546,363 | B1 | 4/2003 | Hagenbuch |
| 6,556,905 | B1 | 4/2003 | Mittelsteadt et al. |
| 6,559,769 | B2 | 5/2003 | Anthony et al. |
| 6,684,137 | B2 | 1/2004 | Takagi et al. |
| 6,831,556 | B1 | 12/2004 | Boykin |
| 6,950,013 | B2 | 9/2005 | Scaman et al. |
| 6,950,122 | B1 | 9/2005 | Mirabile |
| 6,959,122 | B2 | 10/2005 | McIntyre |
| 6,965,400 | B1 | 11/2005 | Haba et al. |
| 7,131,136 | B2 | 10/2006 | Monroe |
| 7,180,407 | B1 | 2/2007 | Guo et al. |
| 7,190,882 | B2 | 3/2007 | Gammenthaler |
| 7,363,742 | B2 | 4/2008 | Nerheim |
| 7,382,244 | B1 | 6/2008 | Donovan et al. |
| 7,570,158 | B2 | 8/2009 | Denny et al. |
| 7,768,548 | B2 | 8/2010 | Silvernail et al. |
| 7,804,426 | B2 | 9/2010 | Etcheson |
| 7,944,676 | B2 | 5/2011 | Smith et al. |
| 8,050,206 | B2 | 11/2011 | Siann et al. |
| 8,446,469 | B2 | 5/2013 | Blanco et al. |
| 8,594,485 | B2 | 11/2013 | Brundula |
| 8,781,292 | B1 | 7/2014 | Ross et al. |
| 8,805,431 | B2 | 8/2014 | Vasavada et al. |
| 9,019,431 | B2 | 4/2015 | Phillips et al. |
| 9,159,371 | B2 | 10/2015 | Ross et al. |
| 9,253,452 | B2 | 2/2016 | Ross et al. |
| 2002/0135679 | A1 | 9/2002 | Scaman |
| 2002/0183905 | A1 | 12/2002 | Maeda et al. |
| 2003/0052798 | A1 | 3/2003 | Hanson |
| 2003/0086000 | A1 | 5/2003 | Siemens et al. |
| 2003/0151663 | A1 | 8/2003 | Lorenzetti et al. |
| 2003/0154009 | A1 | 8/2003 | Basir et al. |
| 2003/0210329 | A1 | 11/2003 | Aagaard et al. |
| 2003/0210806 | A1 | 11/2003 | YoichiShintani et al. |
| 2003/0212567 | A1 | 11/2003 | Shintani et al. |
| 2004/0008255 | A1 | 1/2004 | Lewellen |
| 2004/0201765 | A1 | 10/2004 | Gammenthaler |
| 2004/0252193 | A1 | 12/2004 | Higgins |
| 2005/0083404 | A1 | 4/2005 | Pierce et al. |
| 2005/0099273 | A1 | 5/2005 | Shimomura et al. |
| 2005/0101334 | A1 | 5/2005 | Brown et al. |
| 2005/0151852 | A1 | 7/2005 | Jomppanen |
| 2005/0243171 | A1 | 11/2005 | Ross et al. |
| 2006/0012683 | A9 | 1/2006 | Lao et al. |
| 2006/0133476 | A1 | 6/2006 | Page et al. |
| 2006/0209189 | A1 | 9/2006 | Simpson |
| 2006/0274166 | A1 | 12/2006 | Lee et al. |
| 2007/0013776 | A1 | 1/2007 | Venetianer et al. |
| 2007/0035612 | A1 | 2/2007 | Korneluk et al. |
| 2007/0188612 | A1 | 8/2007 | Carter |
| 2007/0219686 | A1 | 9/2007 | Plante |
| 2007/0260363 | A1 | 11/2007 | Miller |
| 2007/0274705 | A1 | 11/2007 | Kashiwa et al. |
| 2008/0100705 | A1 | 5/2008 | Kister et al. |
| 2009/0002491 | A1 | 1/2009 | Haler |
| 2009/0195655 | A1 | 8/2009 | Pandey |
| 2009/0207252 | A1 | 8/2009 | Raghunath |
| 2010/0026802 | A1 | 2/2010 | Titus et al. |
| 2010/0321183 | A1 | 12/2010 | Donovan et al. |
| 2011/0052137 | A1 | 3/2011 | Cowie |
| 2011/0285845 | A1 | 11/2011 | Bedros et al. |
| 2013/0221189 | A1* | 8/2013 | Kubin ..... F16M 13/04 248/683 |
| 2014/0139680 | A1 | 5/2014 | Huang et al. |
| 2014/0192192 | A1 | 7/2014 | Worrill et al. |
| 2014/0355951 | A1 | 12/2014 | Tabak |
| 2015/0051502 | A1 | 2/2015 | Ross |
| 2015/0197023 | A1 | 7/2015 | Prince et al. |
| 2015/0233669 | A1 | 8/2015 | Ponder |
| 2016/0018849 | A1 | 1/2016 | Tilney |
| 2016/0031382 | A1 | 2/2016 | Chinn et al. |
| 2016/0035391 | A1 | 2/2016 | Ross et al. |

FOREIGN PATENT DOCUMENTS

| | | | |
|---|---|---|---|
| GB | 2287152 | A | 9/1995 |
| GB | 2317418 | A | 3/1998 |
| JP | 2006311039 | A | 11/2006 |
| KR | 1050897 | | 7/2011 |
| WO | WO-1993020655 | A1 | 10/1993 |
| WO | WO-1994019212 | A2 | 9/1994 |
| WO | WO-1995028783 | A1 | 10/1995 |
| WO | WO-1997038526 | A1 | 10/1997 |
| WO | WO-1998052358 | A1 | 11/1998 |
| WO | WO-1999018410 | A1 | 4/1999 |
| WO | WO-01097524 | A1 | 12/2001 |
| WO | WO-2004/036926 | A2 | 4/2004 |
| WO | WO-2007104367 | A1 | 9/2007 |
| WO | WO-2013100993 | A1 | 7/2013 |

OTHER PUBLICATIONS

Raytheon JPS Communications, Ratheon Model 20/20-W, Raytheon 20/20 Vision Digital In-Car Video Systems; Feb. 2010.
Product Review: ICOP Model 20/20-W; May 19, 2009.
State of Utah Invitation to Bid State Cooperative Contract, Contract No. MA503; Jul. 3, 2008.
X26 Taser; date unknown.
Taser X26 Specification Sheet; 2003.
Affidavit of Christopher Butler of Internet Archive attesting to the public availability of the 20/20-W Publication on Nov. 25, 2010.
International Association of Chiefs of Police Digital Video System Minimum Specifications Nov. 21, 2008.
City of Pomona Request for Proposal for Mobile Video Recording System for Police Vehicles; Apr. 4, 2013.
"Taser Int'l (TASR) Challenges to Digital Ally's (DGLY) Patents", StreetInsider.com, http://www.streetinsider.com/Corporate+News/TASER+Intl+(TASER)+Challenges+to+Digital+Allys+(DGLY)+Patents/12302550 html Dec. 1, 2016.
Sony Corporation; "Network Camera: User's Guide: Software Version 1.0: SNC-RZ25N/RZ25P"; 2004; 81 pages.

* cited by examiner

METHOD AND SYSTEM OF SECURING WEARABLE EQUIPMENT

CROSS-REFERENCE TO RELATED APPLICATIONS

This application is a continuation of U.S. patent application Ser. No. 14/821,148, filed on Aug. 7, 2015. U.S. patent application Ser. No. 14/821,148 claims the benefit of U.S. Provisional Patent Application 62/067,586, filed on Oct. 23, 2014. Each of U.S. patent application Ser. No. 14/821,148 and U.S. Provisional Patent Application No. 62/067,586 is incorporated by reference herein in its entirety.

BACKGROUND

In order to allow a user of equipment such as, for example, a camera, the use of both hands, the equipment can be attached to the user's body via, for example, clothing worn by the user. Attachment and removal of the equipment must be easily achieved; however, the equipment also must be securely attachable to the user's body in order to ensure the equipment will not detach when detachment is not desired such as, for example, during strenuous activity by the user. Moreover, the equipment must be secured tightly to the user's body to prevent the equipment from experiencing undesired movement away from the user's body.

SUMMARY

The present invention relates generally to a system and method for securing a device to a user. In one embodiment, the present invention relates to a device-mounting system that includes first and second plates that are selectively attachable to one another. The first plate includes a protrusion that extends outwardly from a face of the first plate. The protrusion includes a pin channel that is adapted to receive a pin. The second plate includes a protrusion housing that includes a recess for receiving the protrusion. The protrusion housing further includes a pin hole that is coaxially aligned with the pin channel when the protrusion is inserted into the recess. The second plate also includes a pin that is slidably mounted to the second plate and is further adapted to penetrate the pin channel and the pin hole when the pin is in a closed position.

In another embodiment, the device mounting system includes a first magnet secured to the first plate and a second magnet secured to the second plate. The first and second magnets are positioned on the first and second plates, respectively, so that the second magnet aligns with the first magnet when the protrusion is inserted into the protrusion housing.

BRIEF DESCRIPTION OF THE DRAWINGS

For a more complete understanding of the present invention thereof, reference may now be had to the following description taken in conjunction with the accompanying drawings, in which.

DETAILED DESCRIPTION

Various embodiments of the present invention will now be described more fully with reference to the accompanying drawings. The invention may, however, be embodied in many different forms and should not be construed as limited to the embodiments set forth herein.

Figure 1:
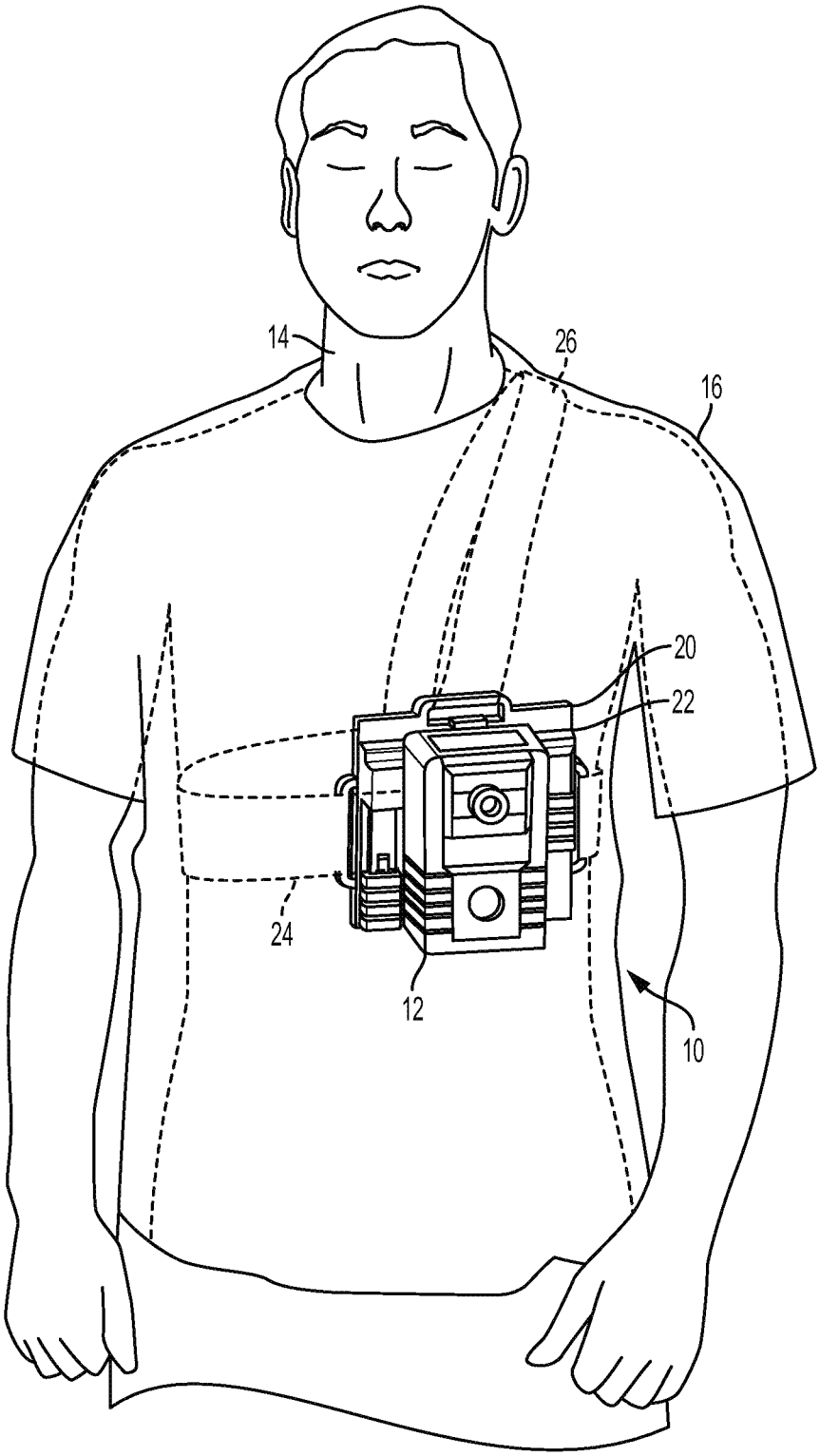
FIG. 1 is a perspective view of a wearable mounting system secured to a user.

Referring now to FIG. 1, a wearable mounting system 10 securing a device 12 to a user 14 is shown. The wearable mounting system 10 includes a bottom plate 20 and a top plate 22. The bottom plate 20 and the top plate 22 may be made from various materials, such as, for example, various plastics or metals. In a typical embodiment, the bottom plate 20 and the top plate 22 may be made from polycarbonate/acrylonitrile butadiene styrene. In a typical embodiment, the bottom plate is attached to the user 14 underneath an article of clothing 16 using lateral strap 24 and a shoulder strap 26. The lateral strap 24 attaches at each end of the lateral strap 24 to the bottom plate 20 and extends around a torso of the user 14. The shoulder strap 26 attaches at a first end to the bottom plate 20 and at a second end to a portion of the lateral strap 24 that is proximate to a back of the user 14. Straps 24 and 26 can be made of various materials, such as, for example, nylon, and can include various adjustment and clasp mechanisms to secure the straps 24 and 26 and provide adjustability.

In another embodiment, the bottom plate 20 may be secured to the user 14 via a hook and loop fastener. For example, the user 14 may wear a vest, such as, for example, a piece of body armor that includes a loop fastener. The bottom plate 20 can include a hook fastener 42 to secure the bottom plate 20 to the vest (e.g., see FIG. 2B). In such an embodiment, the use of lateral strap 24 and shoulder strap 26 is optional. As would be appreciated by a person of ordinary skill in the art, placement of the hook and loop fastener 42 on the bottom plate 20 can be varied as desired to ensure contact with a corresponding hook and loop fastener attached to a user. For example, the hook and loop fastener 42 may comprise one ore more pieces of hook and loop fastener disposed about the bottom plate 20.

The top plate 22 is adapted to be secured to the bottom plate 20 on an outside of the article of clothing 16, thereby sandwiching the article of clothing 16 between the bottom plate 20 and the top plate 22. In a typical embodiment, the top plate 22 is attached to the bottom plate 20 using one or more of a magnetic connection between the bottom plate 20 and the top plate 22, and engagement of the bottom plate 20 by a pin 62 of the top plate 22 (best seen in FIG. 5A).

The device 12 attaches to the top plate 22. The device 12 can be any device, such as, for example, a camera, that the user 14 desires to secure to himself. The top plate 22 includes one or more device-mounting features that interact with the device 12 to secure the device 12 thereto. Exemplary device mounting-features will be discussed in more detail with respect to FIG. 3A.

Figure 2A:
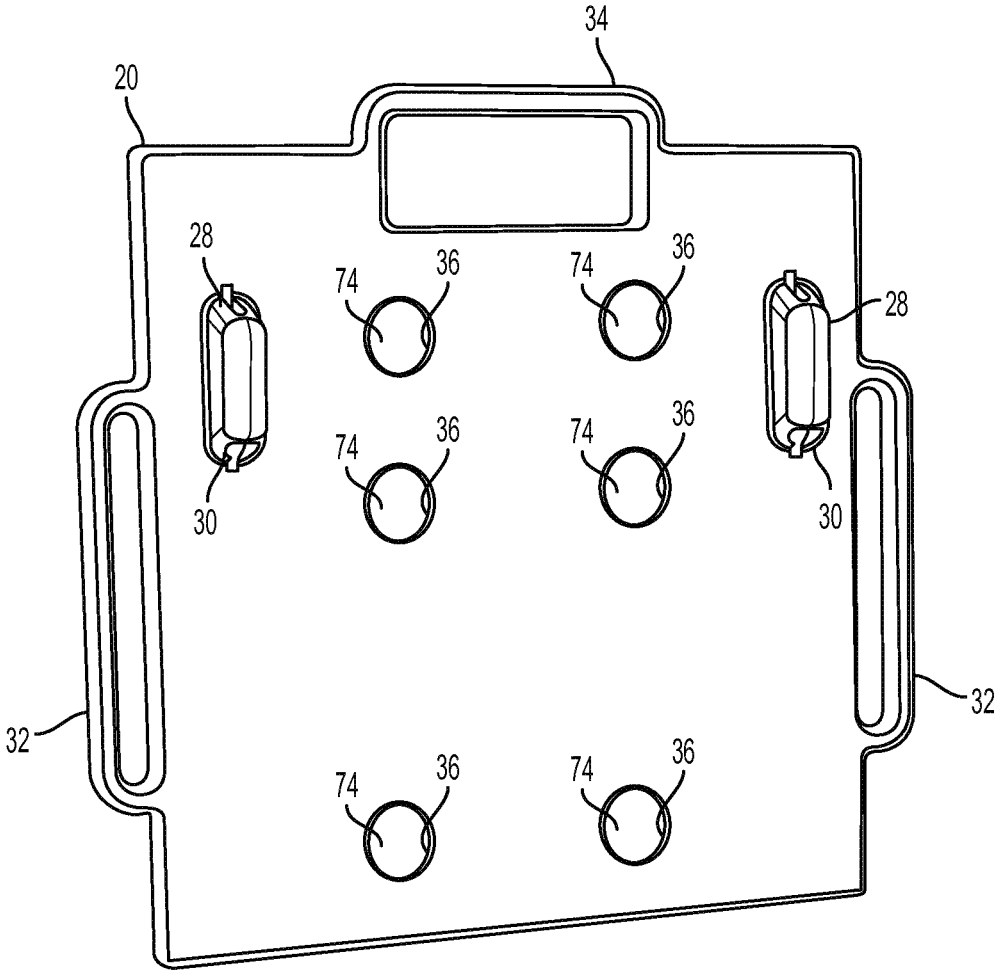
FIG. 2A is a perspective view of a front side of a bottom plate of a wearable mounting system.
Figure 2B:
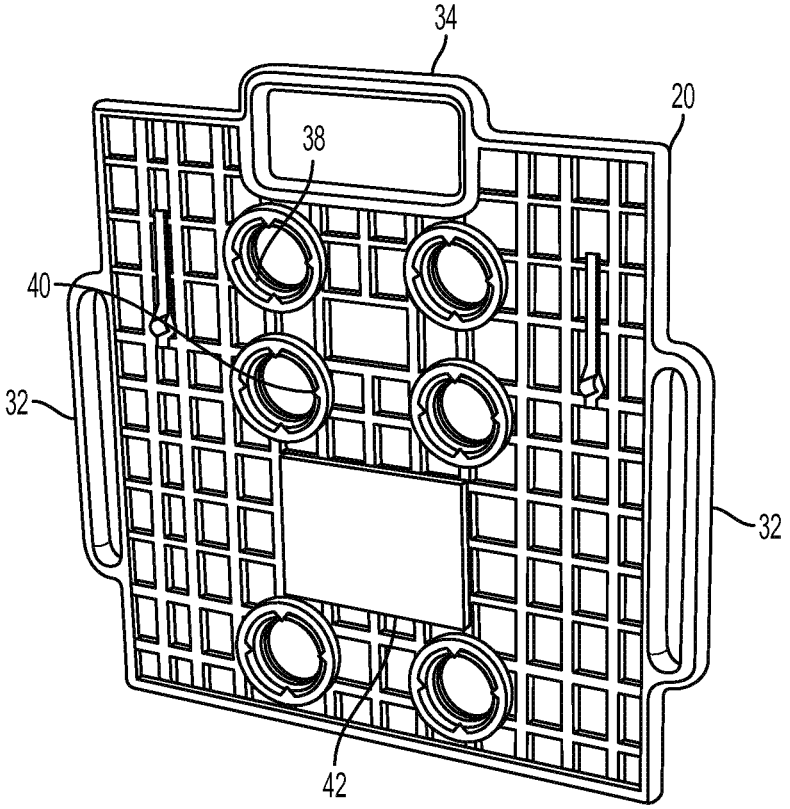
FIG. 2B is a perspective view of a back side of a bottom plate of a wearable mounting system.

Referring now to FIGS. 2A and 2B, a front side and a back side of the bottom plate 20, respectively, are shown in perspective view. In a typical embodiment, the bottom plate 20 includes a pair of protrusions 28, a pair of lateral strap attachment points 32, a shoulder strap attachment point 34, and a plurality of holes 36. The pair of protrusions 28 extend outwardly from the bottom plate 20 and are adapted to fit within a pair of protrusion housings 50 of the top plate 22 (e.g., see FIG. 5A). Each of the pair of protrusions 28 includes a pin channel 30. Pin channel 30 is adapted to receive therethrough the pin 62, which pin 62 is slidably attached to the top plate 22 (best seen in FIGS. 5A and 5B). Each of the pair of lateral strap attachment points 32 are attached to the bottom plate 20 on opposite sides of the bottom plate 20 from one another, and are adapted to each receive one end of the lateral strap 24. The shoulder attachment point 34 is attached to a top side of the bottom plate 20 and is adapted to receive one end of the shoulder strap 26. Each of attachment points 32 and 34 are shown as loops. In another embodiment, the attachment points 32 and 34 can comprise various other clasps, button snaps, or the like to secure the lateral strap 24 and the shoulder strap 26 to the bottom plate 20.

The plurality of holes 36 is adapted to receive magnets 74 to facilitate a magnetic coupling of the bottom plate 20 with the top plate 22. Each of the plurality of holes 36 includes a lip 38 and a plurality of crush tabs 40. Magnets 74 may be secured to holes 36 by pressing the magnets 74 into the holes 36. As the magnets 74 enter the holes 36, the crush tabs 40 deform and establish a force fit between the magnets 74 and the holes 36. The magnets 74 may be further secured to the holes 36 by lining the lips 38 with adhesive. The lips 38 are formed into the bottom plate 20 so that the lips 38 are flush with the front side of the bottom plate 20. Locating the lips 38 in this way helps prevent the magnets 74 from passing through the holes 36 when in close proximity to additional magnets 74 that are secured to the top plate 22. In another embodiment, the back side of the bottom plate 20 may include a portion of a hook and loop fastener 42 to enable the bottom plate 20 to be attached to a corresponding hook and loop fastener disposed on, for example, a vest of the user 14. In another embodiment, the hook and loop fastener 42 may comprise multiple pieces of hook and loop fastener disposed about the back of the bottom plate 20.

Figure 3A:
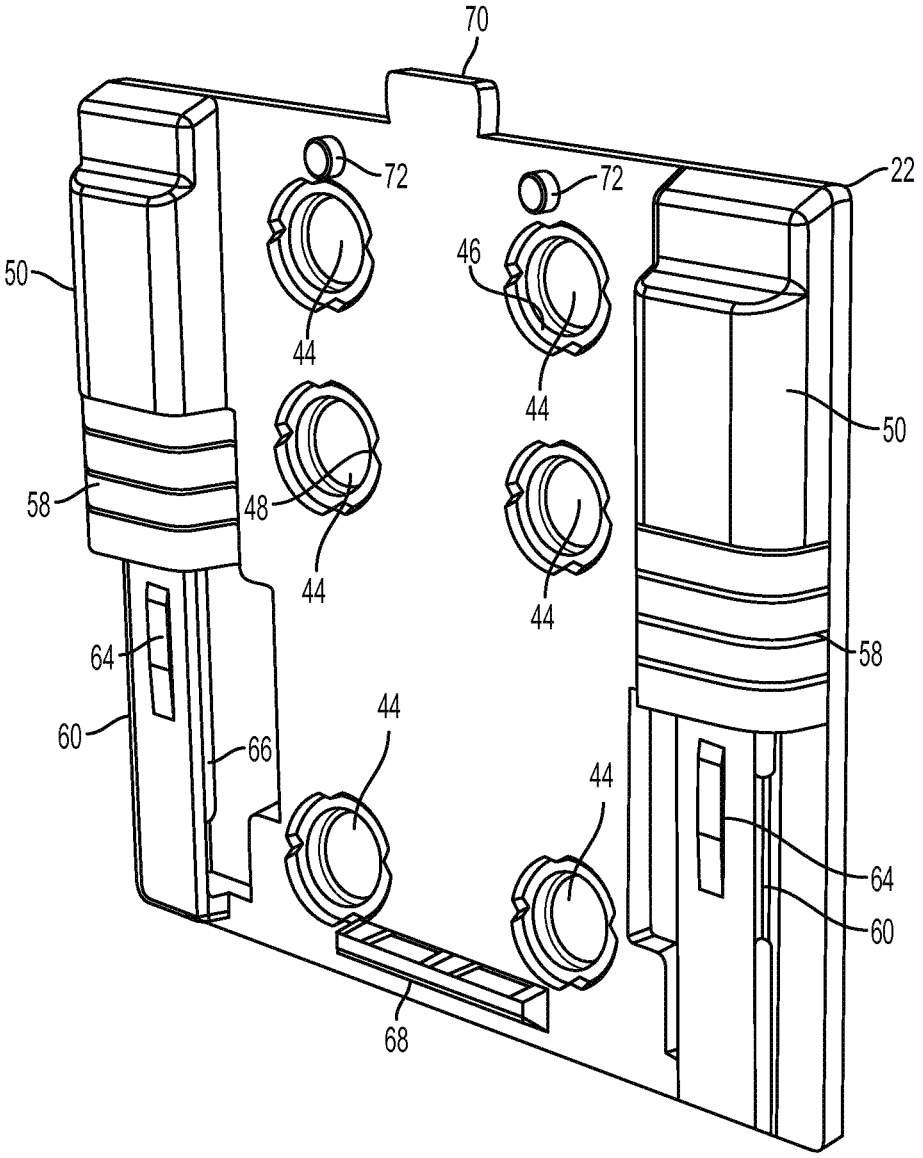
FIG. 3A is a perspective view of a front side of a top plate of a wearable mounting system.
Figure 3B:
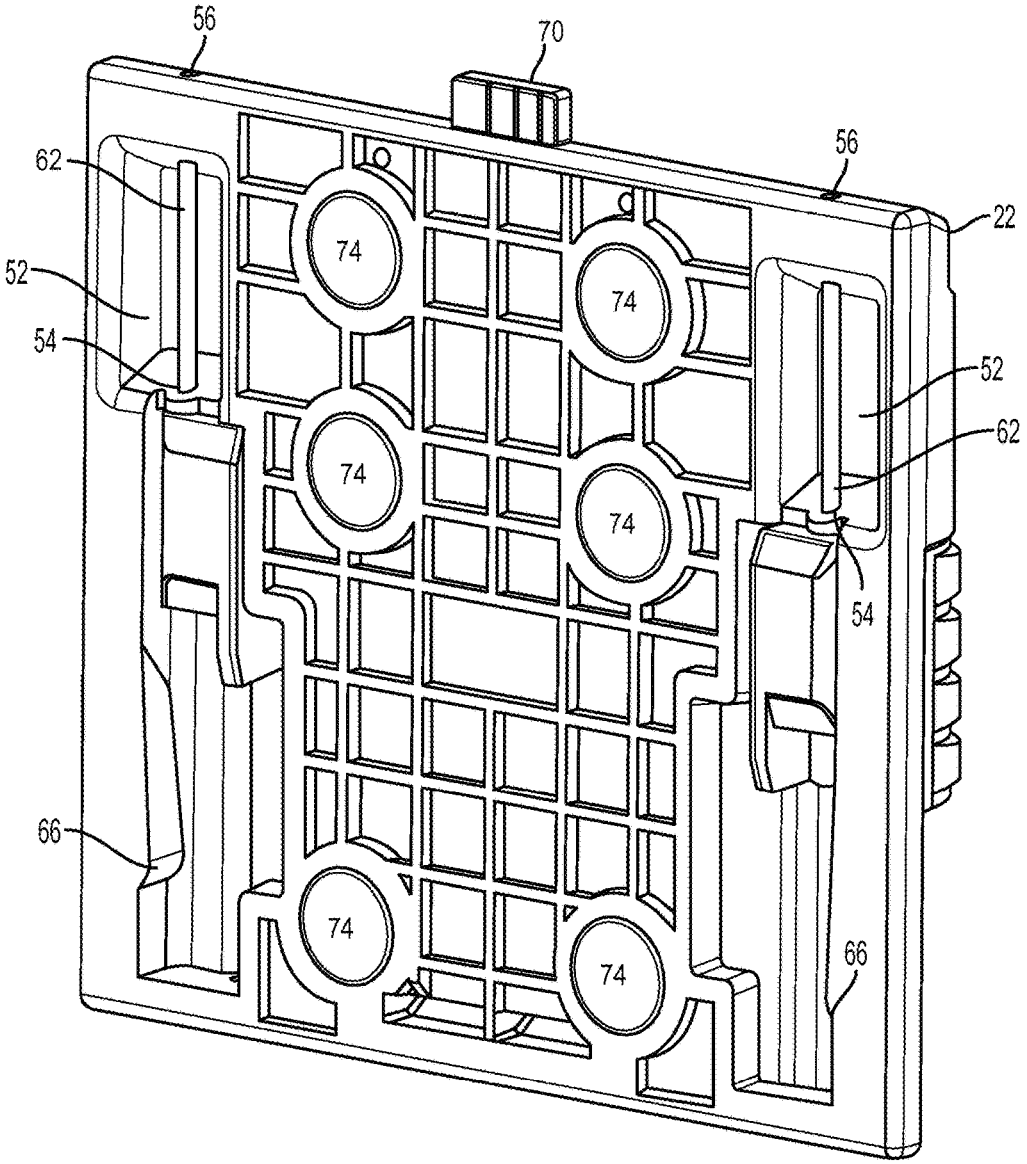
FIG. 3B is a perspective view of a back side of a top plate of a wearable mounting system.

Referring now to FIGS. 3A and 3B, a front side and a back side of the top plate 22, respectively, are shown in perspective view. In a typical embodiment, the top plate 22 includes a plurality of holes 44, a pair of protrusion housings 50, and a pair of sliders 58. Similar to the plurality of holes 36, the plurality of holes 44 are adapted to receive magnets 74. The plurality of holes 44 similarly include lips 46 and crush tabs 48. The lips 46 are formed into the top plate 22 so that the lips 46 are flush with the back side of the top plate 22. Locating the lips 46 in this way helps prevent the magnets 74 from passing through the holes 44 when in close proximity to additional magnets 74 that are secured to the bottom plate 20.

The pair of protrusion housings 50 extends outwardly from the front side of the top plate 22, and each protrusion housing 50 includes a recess 52, a pin hole 54, and a pin hole 56. Each recess 52 is adapted to receive one of the pair of protrusions 28. The pin holes 54 and 56 are coaxially aligned with each other, and are further positioned to be coaxially aligned with the pin channel 30 of the protrusion 28 when the protrusion 28 is inserted into the recess 52.

Each of the pair of sliders 58 is slidably coupled to the top plate 22 via tracks 60, and each of the pair of sliders 58 includes a pin 62 that can be engaged and disengaged with the pin holes 54 and 56 of the protrusion housing 50 by sliding the slider 58 along the track 60. In some embodiments, the tracks 60 include a step 64 that biases the slider 58 into a closed or open position. The step 64 is slightly raised above the track 60 so that the slider 58 must travel up and over the step 64 when being moved along the track 60 between open and closed positions. Other biasing means, such as, for example, a spring, can be used to bias the slider 58 in the closed position. A spring may be attached at a first end to a slider 58 and at a second end to housing 50. In this embodiment, pulling the slider 58 away from the housing 50 is resisted by the spring.

The top plate 22 can further include a pair of tapered shoulders 66 that biases the pair of sliders 58 in the closed position. The tapered shoulders 66 include a ramp-like feature that urges against the pair of sliders 58 as they are retracted away from the protrusion housing 50. When the pair of sliders 58 are fully retracted from the protrusion housings 50, the tapered shoulders 66 act as a temporary stop that biases the pair of sliders 58 in the open position (e.g., see FIG. 5B).

In some embodiments, the top plate 22 further includes various device-mounting features. For example, the top plate 22 may include a lip 68 and a tab 70 that interacts with the device 12 to secure the device 12 to the top plate 22. The top plate 22 can also include a post 72 that fits within a hole or groove in the device 12 to help secure the device 12 against shear forces. Multiple posts 72 may be included on the top plate 22 depending on the design of the device 12. In another embodiment, the top plate 22 may include other device mounting-features such as, for example, clamps, screws, slots, hook and loop fasteners, magnets, and the like.

Figure 4:
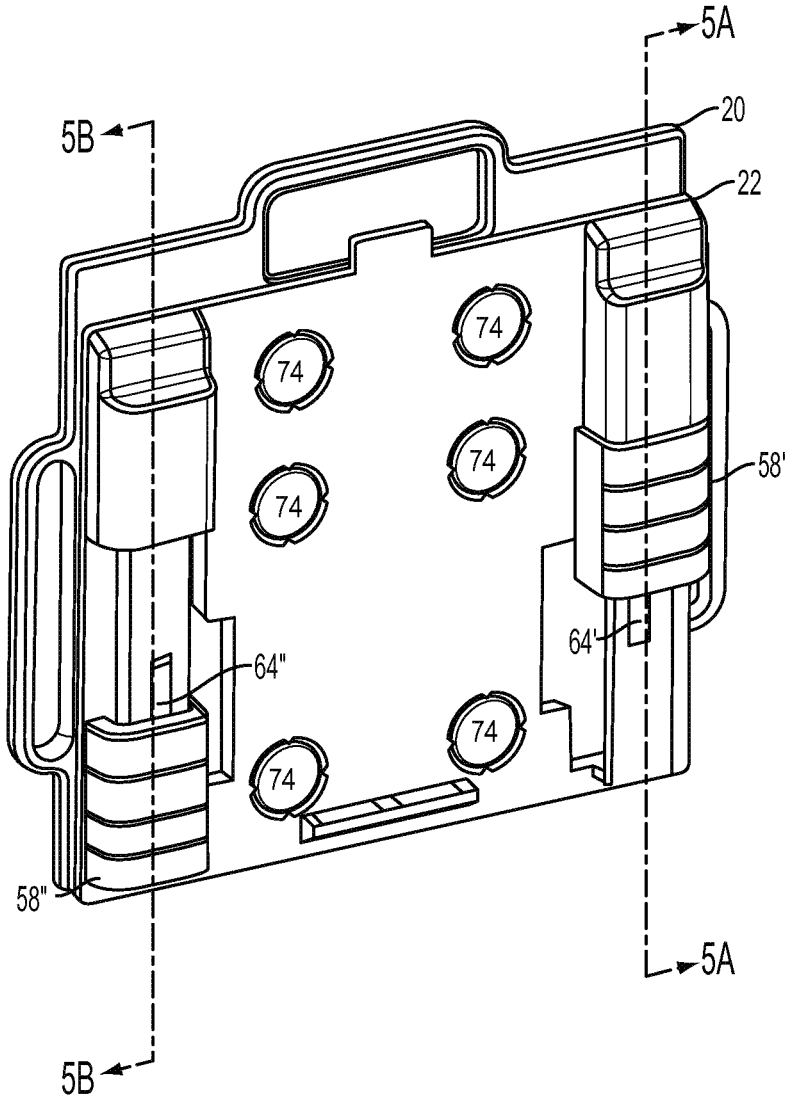
FIG. 4 is a perspective view of a top plate stacked on a bottom plate of a wearable mounting system.
Figure 5A:
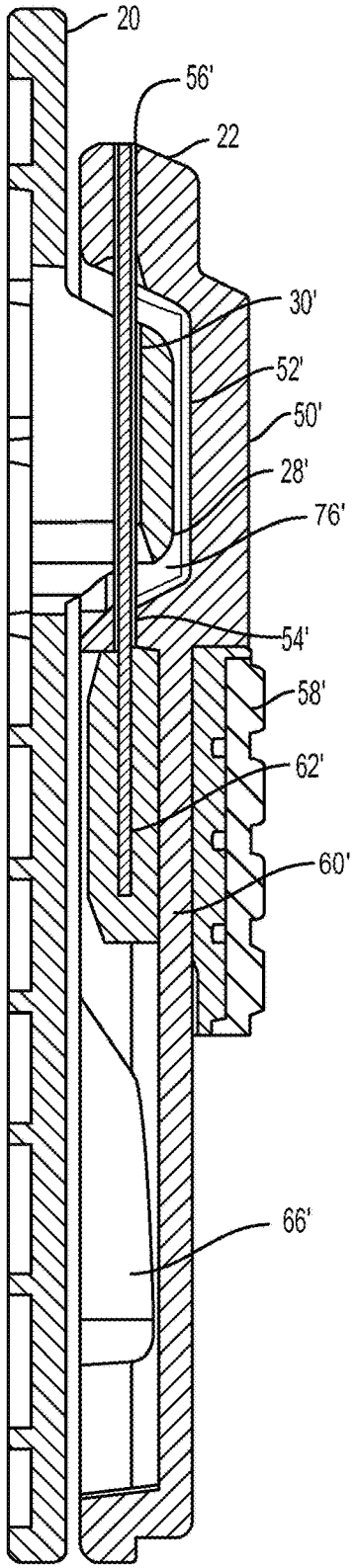
FIG. 5A is a sectioned view of a top plate stacked on a bottom plate of a wearable mounting system with a slideable pin in a closed position.
Figure 5B:
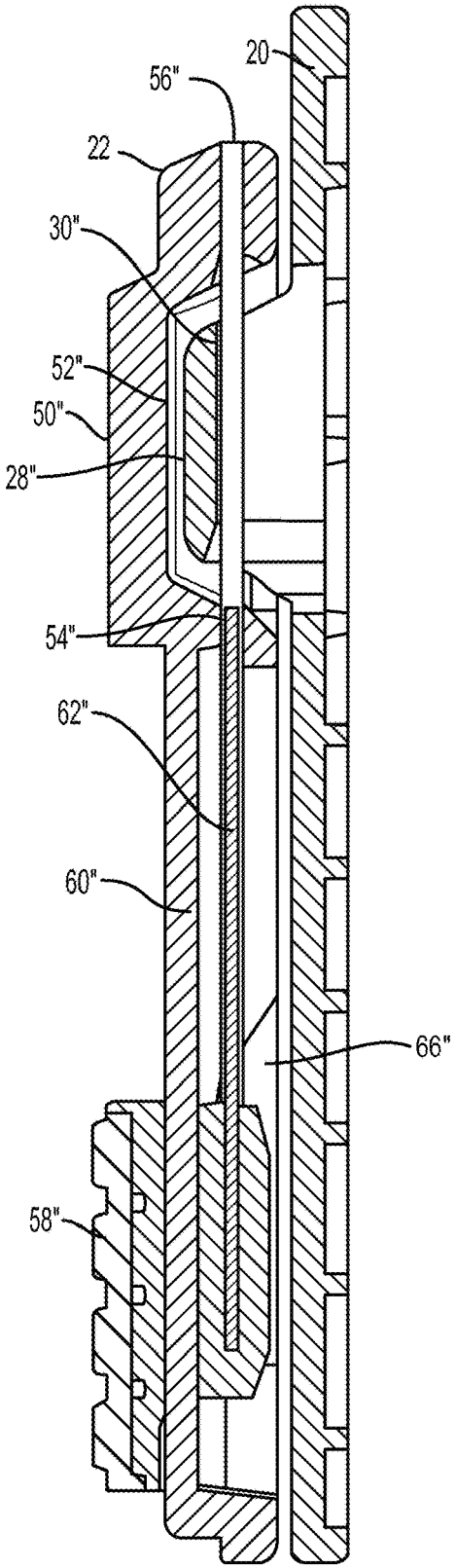
FIG. 5B is a sectioned view of a top plate stacked on a bottom plate of a wearable mounting system with a slideable pin in an open position.

Referring now collectively to FIGS. 4, 5A, and 5B, the top plate 22 is shown stacked on top of the bottom plate 20. The article of clothing 16 is not shown in FIGS. 4, 5A, and 5B to allow a better view of the interaction between the bottom plate 20 and the top plate 22. The top plate 22 is positioned on top of the bottom plate 20 so that each of the pair of protrusions 28 extends into each of the pair of recesses 52. As the top plate 22 approaches the bottom plate 20, the protrusions 28 and an attraction between the magnets 74 of the bottom plate 20 to the magnets 74 of the top plate 22 guides the top plate 22 into an initial attachment position with the bottom plate 20. In the initial attachment position, each pin channel 30 of the pair of protrusions 28 is coaxially aligned with the corresponding pin hole 54 and the pin hole 56 of the corresponding housing 50 to receive the pin 62. The initial attachment position temporarily secures the top plate 22 to the bottom plate 20 until the sliders 58 are slid into a closed position to engage the pins 62 with the pin hole 54, the article of clothing 16, the pin channel 30, and the pin hole 56 (e.g., see FIG. 5A).

In one embodiment, the magnets 74 may each be installed in the bottom plate 20 with their magnetic poles oriented in the same direction. In this instance, the magnets 74 installed in the top plate 22 are likewise installed with their magnetic poles all facing the same direction so as to facilitate a magnetic coupling between the two plates. In another embodiment, the magnets 74 may be installed in the bottom plate 20 with their magnetic poles facing in different directions. For example, the bottom plate 20 may include a first row of magnets 74 with their magnetic poles oriented in a first direction, while a second row of magnets 74 may be oriented with their magnetic poles oriented in a second, opposite direction. In this instance, the magnets 74 installed in the top plate 22 are correspondingly installed so that magnetic coupling between the two plates can occur. Alternating the direction of the magnetic poles of the magnets 74 assists with an alignment of the two plates because, if the plates are not properly aligned, the magnets 74 will repel one another. It will be apparent to those having skill in the art that the protrusions 28 also assist with the alignment of the top plate 22 with the bottom plate 20. However, in embodiments where the protrusions 28 and the protrusion housings 50 are omitted, arrangement of the magnets 74 can help ensure proper alignment of the top plate 22 with the bottom plate 20.

FIG. 4 shows slider 58' in a closed position and slider 58" in an open position. Throughout this disclosure, a part number accompanied by a "prime" symbol indicates a part located on a right side of the wearable mounting system 10 when viewed from the top of the wearable mounting system 10, and a double "prime" indicates a part located on the left side of the wearable mounting system 10 when viewed from the top of wearable mounting system 10. Apart from their relative locations, the parts indicated by "prime" and double "prime" are otherwise the same. In the closed position, a back edge of the slider 58' abuts the step 64' and the pin 62' penetrates the pin hole 54', the pin channel 30', the pin hole 56', and the article of clothing 16. A sectioned view of the slider 58' in the closed position about line A-A is shown in FIG. 5A. In the open position, a front edge of the slider 58" abuts the step 64" and the pin 62" is retracted from the pin hole 56" and the pin channel 30". In one embodiment, the pin 62" is not completely retracted from the pin hole 54". By not retracting the pin 62" entirely out of the pin hole 54", the tip of the pin 62", which is sharp, is covered by the pin hole 54" and limits the possibility of accidental injury to a user. In another embodiment, the pin 62" may be retracted completely from the pin hole 54" when the slider 58 is in the open position. A sectioned view of the slider 58" in the closed position about line B-B is shown in FIG. 5B.

Referring now to FIG. 5A, a sectioned view about line A-A from FIG. 4 is shown. The slider 58' is shown in the closed position with the pin 62' penetrating the pin hole 54', the pin channel 30', and the pin hole 56'. Though not shown, the article of clothing 16 is disposed within a gap 76' between the bottom plate 20 and the top plate 22 when the wearable mounting system 10 is secured to the user 14. When the slider 58' is in the closed position, the pin 62' pierces the article of clothing 16 in two places. The first pierce occurs between the pin hole 54' and the pin channel 30', and the second pierce occurs between the pin channel 30' and the pin hole 56'. When sliders 58' and 58" are both in the closed position, the top plate 22 is secured to the bottom plate 20.

Referring now to FIG. 5B, a sectioned view about line B-B from FIG. 4 is shown. The slider 58" is shown in the open position with the pin 62" retracted from the pin channel 30" and the pin hole 56", but still partially disposed within the pin hole 54". When sliders 58' and 58" are in the open position, the top plate 22 may be removed from the bottom plate 20.

Although various embodiments of the method and system of the present invention have been illustrated in the accompanying Drawings and described in the foregoing Specification, it will be understood that the invention is not limited to the embodiments disclosed, but is capable of numerous rearrangements, modifications, and substitutions without departing from the spirit and scope of the invention as set forth herein. It is intended that the Specification and examples be considered as illustrative only.

What is claimed is:

1. A device-mounting system comprising:

a first plate comprising a face and a protrusion, wherein the protrusion extends outwardly from the face;

a second plate comprising a protrusion housing, wherein the protrusion housing comprises a recess for receiving the protrusion;

a first magnet secured to the first plate;

a second magnet secured to the second plate; and wherein the second magnet aligns with the first magnet when the protrusion is inserted into the protrusion housing.

2. The device-mounting system of claim 1, wherein the protrusion comprises a pin channel.

3. The device-mounting system of claim 2, wherein the protrusion housing comprises a pin hole that is aligned with the pin channel when the protrusion is inserted into the recess.

4. The device-mounting system of claim 3, wherein the second plate further comprises a pin slideably mounted to the second plate and adapted to penetrate the pin channel and the pin hole when the pin is in a closed position.

5. The device-mounting system of claim 1, further comprising:

a third magnet secured to the first plate;

a fourth magnet secured to the second plate; and wherein the first magnet is secured to the first plate with a first magnetic pole orientation and the third magnet is secured to the first plate with a second magnetic pole orientation that is opposite the first magnetic pole orientation.

6. The device-mounting system of claim 5, wherein the second magnetic pole orientation is opposite the first magnetic pole orientation to facilitate a magnetic coupling between the first and second plates.

7. The device-mounting system of claim 1, wherein the first magnet is secured to the first plate within a hole comprising a crush tab and a lip.

8. The device-mounting system of claim 1, further comprising:

a first strap attachment point disposed on a first edge of the first plate;

a second strap attachment point disposed on a second edge of the first plate; and a shoulder strap attachment point disposed on a third edge of the first plate.

9. The device-mounting system of claim 4, further comprising:

a track disposed on a face of the second plate; and a slider movably attached to the track and coupled to the pin.

10. The device-mounting system of claim 9, further comprising a spring attached at a first end to the slider and at a second end to the second plate.

11. A device-mounting system comprising:

a first plate comprising:

a first magnet and a second magnet disposed within a face of the first plate;

a second plate comprising:

a third magnet and a fourth magnet disposed within a face of the second plate; and wherein the third magnet aligns with the first magnet and the fourth magnet aligns with the second magnet when the first plate and second plate are stacked;

a protrusion that extends outwardly from the face of the first plate, the protrusion comprising a pin channel;

a protrusion housing disposed on the second plate, the protrusion housing comprising a recess for receiving the protrusion when the first magnet aligns with the third magnet and the second magnet aligns with the fourth magnet.

12. The device-mounting system of claim 11, wherein the first and second magnets are disposed within the face of the first plate with their magnetic poles oriented in opposite directions.

13. The device-mounting system of claim 11, wherein the first plate further comprises:

a first lateral strap attachment point on a first side of the first plate; and a second lateral strap attachment point on a second side of the first plate.

14. The device-mounting system of claim 11, wherein the second plate further comprises a device-mounting feature.

15. The device-mounting system of claim 11, wherein:

the protrusion housing comprises a recess for receiving the protrusion and a pin hole that is aligned with the pin channel when the protrusion is inserted into the recess; and a pin slideably mounted to the second plate and adapted to penetrate the pin channel and the pin hole when the pin is in a closed position.

16. A method of manufacturing a device-mounting system, the method comprising:

forming a first plate comprising a protrusion, wherein the protrusion extends outwardly from a face of the first plate;

forming a second plate comprising a protrusion housing for receiving the protrusion;

securing a first magnet to the first plate; and securing a second magnet to the second plate; and positioning the second magnet to be in alignment with the first magnet when the protrusion is inserted into the protrusion housing.

17. The method of claim 16, wherein the protrusion comprises a pin channel.

18. The method of claim 17, wherein the protrusion housing comprises a pin hole aligned with the pin channel when the protrusion is inserted into the protrusion housing.

19. The method of claim 18 further comprising:

slideably mounting a pin to the second plate, wherein the pin is configured to penetrate the pin channel and the pin hole when the pin is in a closed position.

20. The method of mounting a device of 16, further comprising:

providing a third magnet secured to the first plate;

providing a fourth magnet secured to the second plate; and wherein the first magnet is secured to the first plate with a first magnetic pole orientation and the third magnet is secured to the first plate with a second magnetic pole orientation that is opposite the first magnetic pole orientation.

21. The method of mounting a device of claim 16, further comprising:

providing the first plate with a hole comprising a crush tab and a lip; and wherein the first magnet is secured in the hole of the first plate, the hole comprising a crush tab and a lip.

* * * * *